US009062881B2

(12) United States Patent
Dresner et al.

(10) Patent No.: US 9,062,881 B2
(45) Date of Patent: Jun. 23, 2015

(54) CONTROL SYSTEM FOR SPACE HEATER/HEARTH

(71) Applicants: Bruce Dresner, St. Louis, MO (US); Frank D. Wurth, Mascoutah, IL (US); David M. Christensen, Sioux Falls, SD (US)

(72) Inventors: Bruce Dresner, St. Louis, MO (US); Frank D. Wurth, Mascoutah, IL (US); David M. Christensen, Sioux Falls, SD (US)

(73) Assignee: Empire Comfort Systems, Inc., Belleville, IL (US)

( * ) Notice: Subject to any disclaimer, the term of this patent is extended or adjusted under 35 U.S.C. 154(b) by 377 days.

(21) Appl. No.: 13/770,446

(22) Filed: Feb. 19, 2013

(65) Prior Publication Data

US 2013/0216962 A1 Aug. 22, 2013

Related U.S. Application Data

(60) Provisional application No. 61/599,716, filed on Feb. 16, 2012.

(51) Int. Cl.
*F23N 1/02* (2006.01)
*F23N 5/24* (2006.01)

(52) U.S. Cl.
CPC ..... *F23N 1/022* (2013.01); *F23N 5/242* (2013.01); *F23N 2023/08* (2013.01); *F23N 2025/04* (2013.01); *F23N 2027/02* (2013.01)

(58) Field of Classification Search
CPC ..... F23N 2005/181; F23N 5/18; F23N 5/242; F23N 1/02; F23N 1/022; F23N 2023/08; F23N 2027/02; F23N 2025/04; F24B 1/1808
See application file for complete search history.

(56) References Cited

U.S. PATENT DOCUMENTS

| | | | |
|---|---|---|---|
| 1,674,337 | A | 6/1928 | Klees et al. |
| 2,133,599 | A | 10/1938 | Turney |
| 2,236,359 | A | 3/1941 | Armstrong |
| 2,242,802 | A | 5/1941 | Stramaglia |
| 2,347,490 | A | 4/1944 | Legeman |
| 2,700,945 | A | 2/1955 | Hill |
| 2,804,870 | A | 9/1957 | Chelini |
| 2,976,026 | A | 3/1961 | Aguirre |
| 3,087,485 | A | 4/1963 | Powers |

(Continued)

OTHER PUBLICATIONS

Corresponding Australian patent application No. 2013200950 Patent Examination Report No. 1 dated Mar. 5, 2014.

*Primary Examiner* — Alfred Basichas
(74) *Attorney, Agent, or Firm* — Polster, Lieder, Woodruff & Lucchesi, L.C.

(57) ABSTRACT

A fuel burning space or zone heating appliance or heater rated or decorative fireplace (hearth appliance) and a method of operating a heater including a gas valve, a pressure transducer, a second pressure measurement device, a combustion fan, and a control. The control compares the signal from the pressure transducer to the signal from the second pressure measurement device. If the signals do not sufficiently correspond, the control prevents the gas valve from opening. If the signals sufficiently correspond, the control performs an ignition sequence and opens the gas valve. The control also compares the signal from the pressure transducer to a desired value based on a current input gas rate through the gas valve. If the signal is greater than the desired value, the control decreases power to the combustion fan. If the signal is less than the desired value, the control increases power to the combustion fan. If the signal is less than the desired value, the control turns the gas valve off to cease ignition.

12 Claims, 2 Drawing Sheets

(56) References Cited

U.S. PATENT DOCUMENTS

| | | | |
|---|---|---|---|
| 3,240,205 | A | 3/1966 | Helland |
| 3,289,936 | A | 12/1966 | Coburn |
| 3,511,265 | A | 5/1970 | Martin |
| 4,085,893 | A | 4/1978 | Durley, III |
| 4,239,956 | A | 12/1980 | Morton |
| 4,261,326 | A | 4/1981 | Ihlenfield |
| 4,336,790 | A | 6/1982 | Bartsch |
| 4,381,759 | A | 5/1983 | Faustini |
| 4,478,206 | A | 10/1984 | Ahn |
| 4,500,479 | A | 2/1985 | Fukami et al. |
| 4,706,884 | A | 11/1987 | Brauer |
| 4,892,045 | A | 1/1990 | Schumacher |
| 5,347,980 | A | 9/1994 | Shellenberger |
| 5,368,010 | A | 11/1994 | Weber, III et al. |
| 5,607,294 | A | 3/1997 | Gianpiero et al. |
| 5,664,555 | A | 9/1997 | Maschhoff et al. |
| 5,704,343 | A | 1/1998 | Ahn et al. |
| 5,720,231 | A | 2/1998 | Rowlette et al. |
| 5,740,790 | A | 4/1998 | Lipsky |
| 5,749,355 | A | 5/1998 | Roan et al. |
| 5,775,318 | A | 7/1998 | Haydock et al. |
| 6,003,544 | A | 12/1999 | Turrin et al. |
| 6,082,388 | A | 7/2000 | Turrin et al. |
| 6,598,599 | B2 | 7/2003 | Takeuchi |
| 6,672,326 | B2 | 1/2004 | Pappalardo et al. |
| 6,684,878 | B2 | 2/2004 | Ho et al. |
| 6,820,480 | B2 | 11/2004 | De'Stefani et al. |
| 7,007,923 | B2 | 3/2006 | Dorigo et al. |
| 7,275,533 | B2 | 10/2007 | Soeholm et al. |
| 7,699,072 | B2 | 4/2010 | Benvenuto |
| 7,710,283 | B1 | 5/2010 | Cantolino |
| 7,802,984 | B2 | 9/2010 | Specht |
| 7,950,919 | B2 | 5/2011 | Johnson et al. |
| 8,151,621 | B1 | 4/2012 | Cantolino |
| 2002/0070465 | A1 | 6/2002 | Harvel et al. |
| 2008/0083404 | A1 | 4/2008 | Rappold |
| 2009/0293867 | A1 | 12/2009 | Chian et al. |
| 2011/0003260 | A1 | 1/2011 | Zanella |
| 2011/0217664 | A1 | 9/2011 | Barduca et al. |
| 2011/0226355 | A1 | 9/2011 | Benvenuto et al. |
| 2013/0108971 | A1 | 5/2013 | Maiello et al. |
| 2014/0262145 | A1 | 9/2014 | Carson |

CONTROL SYSTEM FOR SPACE HEATER/HEARTH

CROSS REFERENCE TO RELATED APPLICATIONS

The present application claims priority to U.S. Provisional Patent Application No. 61/599,716, the contents of which are incorporated herein by reference.

FIELD OF THE INVENTION

The invention relates generally to gas fired heating control systems and more specifically to control systems for gas fired fuel burning space or zone heating appliance or heater rated or decorative fireplace (hearth appliances).

BACKGROUND OF THE INVENTION

In the past, gas heating appliances used a gas valve that was opened to supply combustion fuel to the appliance and closed to stop combustion fuel to the heater. High efficiency gas heating appliances use a forced air induction system to supply combustion airflow to the heater. In the past, a simple switch has been used to determine whether the combustion airflow was sufficient for safe operation. The switch did not measure the value of the combustion airflow, but rather merely determined whether airflow over a prescribed value was present. Typically, the combustion air blower motor did not have multiple speeds, but rather ran at a single speed. Therefore, if the switch detected insufficient airflow, the gas valve would be turned off to prevent unsafe operation rather and the heating appliance would cease operation. Past systems did not reduce gas flow or increase the inducer motor speed to attempt to supply more airflow.

Modern heaters increasingly incorporate modulating gas valves that provide two or more defined or infinitely controllable gas input rates for more efficient operation. The appropriate combustion airflow rate for safe operation is different for the different gas input rates and therefore, when an appliance has multiple defined or infinitely controllable gas input rates the control system will typically have the ability to select different speed taps of a combustion air blower motor (or to provide a variable current input to a variable speed motor) to supply one of a number of possible airflows. Typically, to assure safe operation, multiple pressure switches have been implemented to ensure that the appliance operates at a safe level of combustion airflow for the selected gas input rate.

However, the use of multiple pressure switches is expensive and does not allow a heater control system to determine the precise airflow that is being accomplished in the particular heater installation. By failing to determine the actual airflow, the most efficient and safe airflow for a given gas input level cannot be obtained. This is also important because different heater installations will have different lengths and configurations of inducer air supply and exhaust pipe, which will present different amounts of backpressure which, in turn, will cause different airflows at a given inducer fan speed.

Therefore, there is a need for a control system that can provide for efficient operation of a heater in a plurality of installation environments by determining the actual inducer airflow present.

SUMMARY OF THE INVENTION

The present invention provides a fuel burning space or zone heating appliance or heater rated or decorative fireplace (hearth appliance) and a method of operating it comprising providing a gas valve, a pressure transducer, a second pressure measurement device, and a combustion fan. Further provided is a control for receiving signals from the pressure transducer and the second pressure measurement device. The control further provides outputs to control a speed of the combustion fan and the state of the gas valve.

During initial operation, the control compares the signal from the pressure transducer to the signal from the second pressure measurement device. If the signal from the pressure transducer does not sufficiently correspond to the signal from the second pressure measurement device, the control will not allow the gas valve to open.

If the signal from the pressure transducer sufficiently corresponds to the signal from the second pressure measurement device, the control performs an ignition sequence and opens the gas valve. The control also compares the signal from the pressure transducer to a desired value based on a current input gas rate through the gas valve. If the signal from the pressure transducer is greater than the desired value, the control decreases power to the combustion fan. If the signal from the pressure transducer is less than the desired value, the control increases power to the combustion fan.

DETAILED DESCRIPTION OF THE PREFERRED EMBODIMENT

Figure 1:
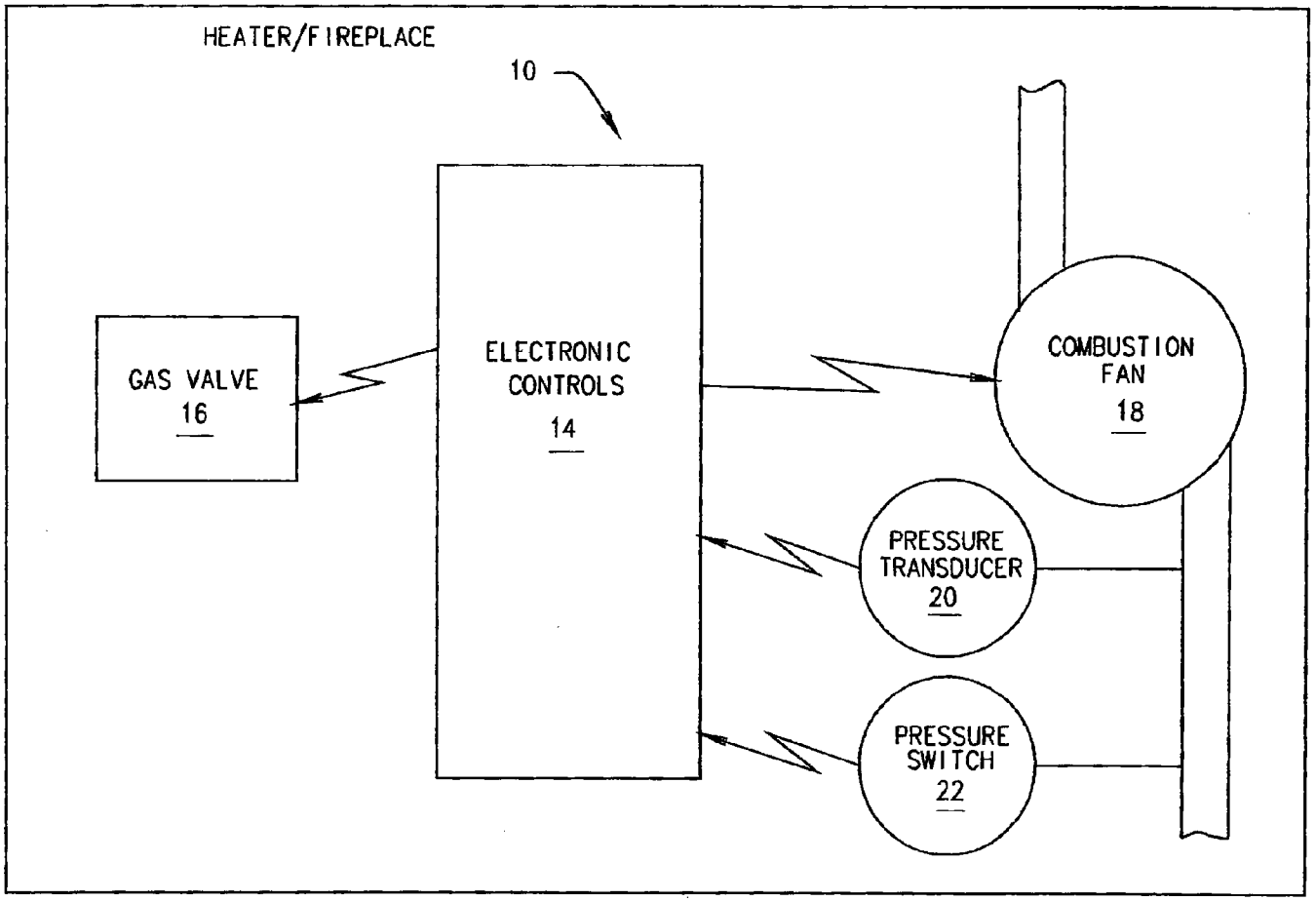
FIG. 1 is a block diagram illustrating the configuration of the system.

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the broad aspect of the invention to the embodiment illustrated.

The present invention provides a heating appliance or decorative fireplace and control system that continuously monitors the output from a pressure transducer while the appliance is firing and compares this pressure output with predefined values. By doing so, the control can monitor for both optimum combustion airflow, ensure adequate combustion airflow for safe operation. Because heaters are installed in diversely different installation environments, each heating appliance or decorative fireplace will be attached to piping for providing inducer airflow that entails very different configurations, such as the number of turns, pipe diameter and length of pipe that will affect inducer airflow back pressure. The result is that inducer airflow at a given inducer motor speed will result in differing amounts of inducer airflow. The present invention allows for efficient heating appliance or decorative fireplace combustion by allowing the control system to determine an actual airflow present in the particular installation and vary the inducer fan motor speed to obtain a desired airflow for a particular gas combustion rate.

This also allows a control to maintain both optimum and adequate combustion airflow for many gas flow rates without the added cost and complexity of multiple pressure switches. Instead of multiple pressure switches, the control contains a table of pressure transducer output values for each specified gas input rate, which yields a system that can offer several predetermined gas inputs or true modulating of the gas input.

It should be noted that using a transducer as a safety device requires a transducer that meets the requirements of Underwriters Laboratories Standard UL353. For each gas input rate the control contains a value for the optimum pressure transducer output and the minimum pressure transducer output. The control system adjusts the power level to the combustion air blower motor in order to achieve the optimum pressure transducer output value. If the control sends maximum power to the combustion air blower and the minimum pressure transducer output value cannot be achieved, a potentially unsafe condition exists due to inadequate combustion airflow. In this situation, the control will close the gas valve.

A gas appliance and control system according to the present invention comprises a heater 10 that includes a microprocessor control 14 for detecting and/or controlling flame sensing, timing and ignition retries. The heater 10 further comprises a modulating gas valve 16 with multiple levels of gas flow or with fully modulating gas flow and a combustion fan 18 for providing combustion air flow appropriate for a particular gas flame modulation level and back pressure of venting attached to the heater 10. The control 14 further provides safety functions to avoid excessive temperatures, inadequate combustion airflow, unsupervised gas flow/flame or other unsafe conditions, diagnostic functions to monitor control state and generate diagnostic codes for problems, as further explained below.

When there is a call for heat, the electronic controls 14 will energize the combustion fan 18. Readings from a pressure transducer 20 are fed back to the electronic controls 14. Once a pressure switch 22 closes, the reading from the pressure transducer 20 is compared to the set point for the pressure switch 22. The set point value is stored in the electronic controls 14. Once the pressure switch 22/pressure transducer 20 comparison is made, the combustion fan 18 is de-energized to a point where the pressure switch 22 opens. At this point, the measurement of the pressure transducer 20 is compared to the open setting of the pressure switch 22. If the values are within tolerance, the control system 14 will allow the unit 10 to proceed to the ignition cycle. If the values are not in tolerance, the control system 14 will not allow ignition.

Once ignition occurs, the electronic controls 14 will continuously receive feedback from the pressure transducer 20 to ensure air delivered for combustion is adequate for combustion at a given gas input value. Power to the combustion fan 18 will be increased or decrease based on the value returned from the pressure transducer 20. If maximum power is provided to the combustion fan 18, but adequate combustion air pressure is still not achieved, as measured by the pressure transducer 20, then the electronic controls 14 will stop gas flow to end fuel ignition. In this manner, the pressure transducer operates as a safety device to prevent inadequate combustion airflow in the heater for any particular value of gas value modulation.

Figure 2:
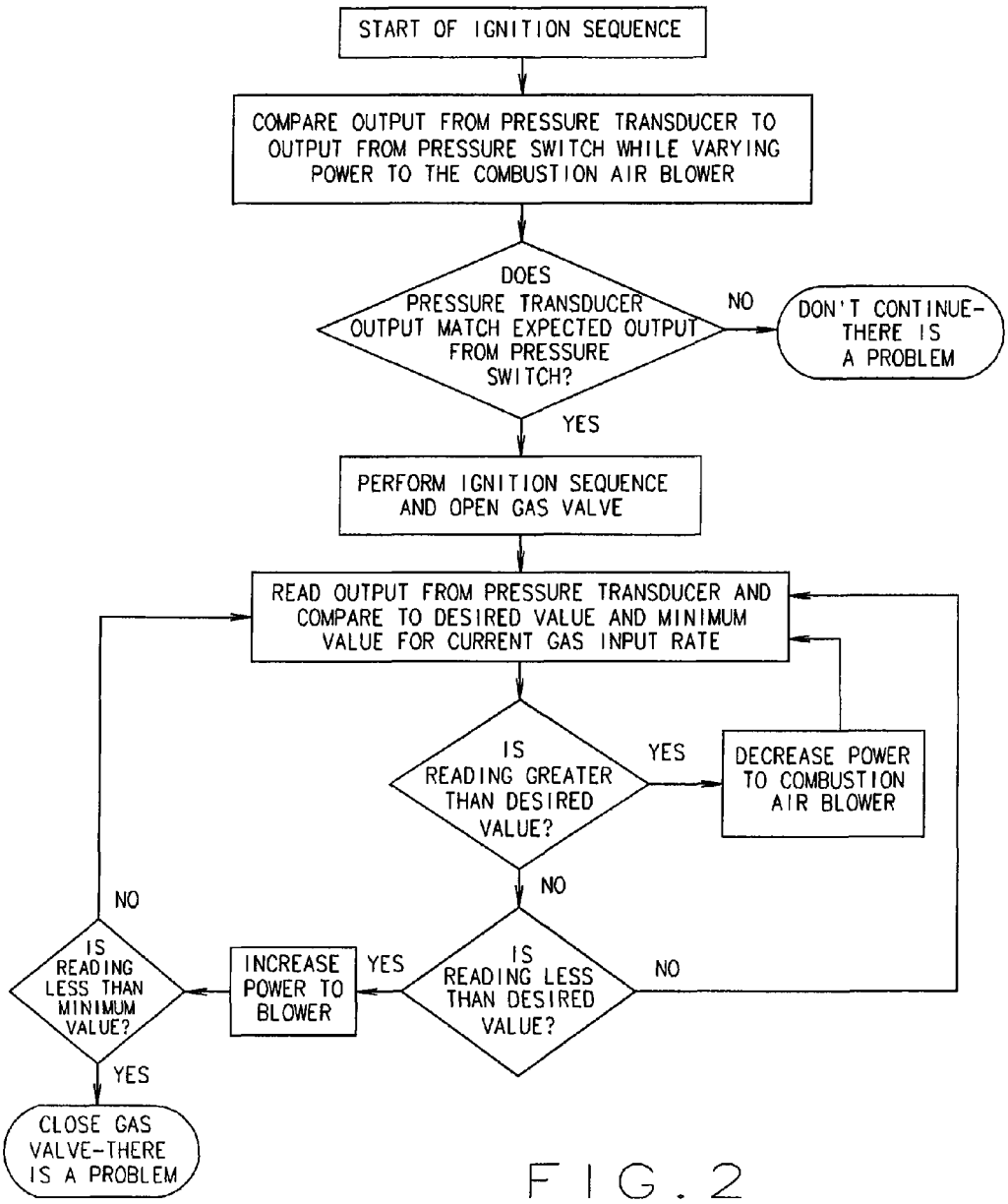
FIG. 2 is a flowchart illustrating operation of the control system.

A flow chart exemplifying control 14 operation according to an embodiment of the present invention is illustrated in FIG. 2. The ignition sequence begins by comparing the output from the pressure transducer 20 to the output from the pressure switch 22 while varying power to the combustion fan 18. Specifically, the combustion fan 18 speed is increased while the output of the pressure transducer 20 and pressure switch 22 is monitored. When the pressure switch 22 closes as the combustion airflow reaches the pressure switch's 22 setpoint, the output of the value of the pressure transducer 20 is determined and compared to an expected value stored within the control 14. Next, the speed of the combustion fan 18 is reduced while the output of the pressure switch 22 and pressure transducer 20 continues to be monitored. When the pressure switch 22 opens as the combustion airflow falls below the pressure switch's 22 setpoint, the output of the value of the pressure transducer 20 is again determined and compared to an expected value stored within the control 14.

If the output of the pressure transducer 20 does not match the expected values (within a tolerance) at the points that the pressure switch 22 closes and opens, the control 14 determines that a defective pressure transducer 20 or pressure switch 22 is present in the system, and heater operation is terminated. An error code may also be generated. If the pressure transducer 20 output matches the expected value (within a tolerance) as the pressure switch 22 closes and opens, the ignition sequence is performed and the gas valve is opened.

Following ignition, the control 14 compares the output from the pressure transducer 20 to a desired value and a minimum value for the current gas input rate stored in the controller 14. The desired value represents the most efficient airflow for combustion at the particular gas valve modulation setting or a particular level of gas flow for a non-modulating valve. The minimum value represents the minimum safe airflow for combustion at the particular gas valve setting.

If the reading from the pressure transducer 20 is greater than the desired value, power to the combustion fan 18 is reduced and the comparison is then repeated. If the reading from the pressure transducer 20 is less than the desired value, power to the combustion fan 18 is increased and the reading is again compared to the desired value. When maximum power has been supplied to the combustion fan 18, if the pressure transducer 20 reading remains less than the minimum desired value, minimum adequate airflow has not been achieved, and the gas valve 16 is closed. An error code may also be generated. If the reading is not insufficient such that the gas valve is closed, the control 14 continues to monitor the pressure transducer 20 to ensure the presence of the efficient and sufficient airflow.

It will be understood by one of ordinary skill in the art that the pressure switch could be replaced by a second pressure transducer and the output values of the pressure transducer compared to determine whether they are identical (within a tolerance) without departing from the scope of the present invention. The terms "pressure measurement device" as used herein includes both pressure transducers and pressure switches.

The above example shows that the invention, as will be defined by the claims, has far ranging application and should not be limited merely to the embodiment shown and described in detail. Instead the invention should be limited only to the words of the claims. Aspects of the preferred embodiment not claimed are not intended to be part of the claimed invention. Applicant intends the scope of the protection to be only limited by the scope of the patent claims.

We claim:

1. A method of operating a heater/hearth comprising:

providing a gas valve, a pressure transducer, a second pressure measurement device, and a combustion fan;

providing a control for receiving a signal from the pressure transducer and receiving a signal from the second pressure measurement device and for providing an output signal to control a speed of the combustion fan and providing an output signal to control a state of the gas valve;

with the control, comparing the signal from the pressure transducer to the signal from the second pressure measurement device;

if the signal from the pressure transducer does not sufficiently correspond to the signal from the second pressure measurement device, the control will not signal the gas valve to open; and if the signal from the pressure transducer sufficiently corresponds to the signal from the second pressure measurement device, with the control:

a) performing an ignition sequence and opening the gas valve;

b) comparing the signal from the pressure transducer to a desired value based on a current input gas rate through the gas valve;

c) if the signal from the pressure transducer is greater than the desired value, decreasing power to the combustion fan.

2. The method of controlling a heater/hearth of claim 1 further comprising the step of if the signal from the pressure transducer sufficiently corresponds to the signal from the second pressure measurement device, if the signal from the pressure transducer is less than the desired value, increasing power to the combustion fan.

3. The method of claim 1 wherein the second pressure measurement device comprises a pressure transducer.

4. The method of claim 1 wherein the second pressure measurement device comprises a pressure switch.

5. The method of claim 1 further comprising the step of, if the signal from the pressure transducer sufficiently corresponds to the signal from the second pressure measurement device, with the control:

a) comparing the signal from the pressure transducer output to a minimum value based on a current input gas rate through the gas valve;

b) if the signal from the pressure transducer is less than the minimum value when full power has been supplied to the combustion fan, providing a signal to close the gas valve.

6. A heater/hearth comprising:

a gas valve, a pressure transducer, a second pressure measurement device, and a combustion fan;

a control connected to the pressure transducer and the second pressure measurement device to receive a signal therefrom, connected to the combustion fan to control its speed and connected to a gas valve to control its state;

wherein the control is adapted to compare the signal from the pressure transducer to the signal from the second pressure measurement device;

wherein, if the signal from the pressure transducer does not sufficiently correspond to the signal from the second pressure measurement device, the control is adapted to generate an error code and to turn the gas valve off; and wherein, if the signal from the pressure transducer sufficiently corresponds to the signal from the second pressure measurement device, the control is adapted to opening the gas valve and ignite a flame, compare the signal from the pressure transducer to a desired value based on a current input gas rate through the gas valve, modify the speed of the combustion fan to obtain a desired output signal from the pressure transducer.

7. The heater/hearth of claim 6 wherein the second pressure measurement device comprises a pressure transducer.

8. The method of claim 6 wherein the second pressure measurement device comprises a pressure switch.

9. A method of operating a heater/hearth comprising:

providing a gas valve, a pressure transducer, a second pressure measurement device, and a combustion fan;

providing a control for receiving a signal from the pressure transducer and receiving a signal from the second pressure measurement device and for providing an output signal to control a speed of the combustion fan and providing an output signal to control a state of the gas valve;

with the control, comparing the signal from the pressure transducer to the signal from the second pressure measurement device;

if the signal from the pressure transducer does not sufficiently correspond to the signal from the second pressure measurement device, the control will not signal the gas valve to open;

if the signal from the pressure transducer sufficiently corresponds to the signal from the second pressure measurement device, with the control:

a) performing an ignition sequence and opening the gas valve;

b) comparing the signal from the pressure transducer to a desired value and a minimum value based on a current input gas rate through the gas valve;

c) if the signal from the pressure transducer is greater than the desired value, decreasing power to the combustion fan; and d) if the signal from the pressure transducer is less than the desired value or the minimum value, increasing power to the combustion fan.

10. The method of claim 9 further comprising the step of if the signal from the pressure transducer is less than the minimum value and full power is being supplied to the combustion fan, closing the gas valve to cease.

11. The method of claim 9 wherein the second pressure measurement device comprises a pressure transducer.

12. The method of claim 9 wherein the second pressure measurement device comprises a pressure switch.

* * * * *